US005544667A

United States Patent [19]

Landua et al.

[11] Patent Number: 5,544,667

[45] Date of Patent: Aug. 13, 1996

[54] APPARATUS AND A PROCEDURE FOR CLEANING TOOLS DURING THE MANUFACTURE OF SHELLS OR CORE PACKETS THAT ARE READY FOR CASTING

[75] Inventors: Werner Landua; Wolfgang Schimpf, both of Mannheim, Germany

[73] Assignee: Adolf Hottinger Maschinenbau GmbH, Mannheim, Germany

[21] Appl. No.: 271,062

[22] Filed: Jul. 5, 1994

[30] Foreign Application Priority Data

Jul. 5, 1993 [DE] Germany ..... 43 22 192.0
Jul. 9, 1993 [DE] Germany ..... 43 23 107.1

[51] Int. Cl.[6] ..... B08B 3/10

[52] U.S. Cl. ..... 134/64 R; 134/111; 134/184; 134/122 R; 134/74

[58] Field of Search ..... 134/64 R, 122 R, 134/74, 72, 73, 14, 184; 164/158

[56] References Cited

U.S. PATENT DOCUMENTS

| | | | |
|---|---|---|---|
| 2,710,819 | 6/1955 | Weber et al. | 134/74 |
| 2,718,714 | 9/1955 | Bocchino | 134/102.3 |
| 2,761,799 | 9/1956 | Schroeder | 134/74 |
| 2,834,359 | 5/1958 | Kearney | 134/74 |
| 3,120,853 | 2/1964 | Kearney et al. | 134/74 |
| 3,604,435 | 9/1971 | Day, Jr. | 134/102.3 |
| 4,135,569 | 1/1979 | Drobnik et al. . | |
| 4,936,328 | 6/1990 | Yatabe | 134/76 X |
| 5,114,494 | 5/1992 | Remec | 134/184 |
| 5,218,980 | 6/1993 | Evans | 134/184 |

FOREIGN PATENT DOCUMENTS 2304564 8/1974 Germany .

*Primary Examiner*—Frankie L. Stinson
*Attorney, Agent, or Firm*—Bell, Seltzer, Park & Gibson, P.A.

[57] ABSTRACT

An apparatus for cleaning tools during the manufacture of shells or core packets that are ready for casting, by means of core shooters or shooting stations that are preferably in a linear arrangement, the core shooter comprising tool sets consisting of a tool upper section, an ejector plate of the tool upper section, and a tool lower section, it being possible to uncouple the tool set from the core shooter and remove it preferably to a tool store (5), is provided, for purposes of ensuring rapid and fully automatic tool cleaning, with a delivery system (6), a first flushing system (7), at least one ultrasound bath (8), a second flushing system (9), optionally, a cooling system (10), a drying system (12), optionally an inspection station (13), and a removal system (14), the tool sets (4) being moved by means of the delivery system (6) from the core shooters or from the tool store (5) to a first manipulator (15), from this into the first flushing system (7), preferably by means of a second manipulator (16) into the ultrasound bath (8), into the second flushing system (9), optionally into the cooling system (10), and from there to the drying system (12),preferably by means of a third manipulator (17), optionally into the inspection station (13), to the removal system (14) and by means of this once again into the tool store (5) or to the core shooters.

8 Claims, 6 Drawing Sheets

APPARATUS AND A PROCEDURE FOR CLEANING TOOLS DURING THE MANUFACTURE OF SHELLS OR CORE PACKETS THAT ARE READY FOR CASTING

BACKGROUND OF THE INVENTION

The present invention relates to an apparatus for cleaning molds, also referred to herein as tool sets, during the manufacture of shells or core packets that are ready for casting, by means of core shooters or shooting stations that are preferably in a linear arrangement, the core shooter in each instance incorporating tool sets consisting of a tool upper section, an ejector plate of the tool upper section and a tool lower section, it being possible to uncouple the tool sets from the core shooters and, preferably, eject them into a tool store.

In principle, the present invention relates to the field of casting technology. In order to cast shaped pieces, casting cores or casting molds are in most instances manufactured in separate parts, combined, and then joined together to form a casting mold or a core packet. Then, in order to produce, for example, metal work pieces, these core packets are filled with molten metal, whereafter, in series production, the core packets that are to be filled with molten metal pass through the production line lined up one behind the other.

Apparatuses to manufacture core packets of the type under discussion herein are already known from numerous publications. Solely as an example, reference is made herein to DE-OS 23 04 564. Also known from practice is the fact that the cores that are to be joined together to form a core packet are produced in a production line with a series of core shooters or shooting stations that incorporate a plurality of shot hoods, when the core packet has an additional core added to it at each shooting station that incorporates a shot hood. To this end, the cores are laid on a transit element that passes through the individual shooting stations when, in most instances, this transit element simultaneously serves as the tool lower section of the first shooting station.

The sand that is used to produce the core packets is always mixed with binding agent and this causes considerable soiling of the tools—the upper tool section with the ejector plate and the tool lower section. Accordingly, the tools have to be cleaned after a specific number of cycles and also be replaced in the shooting stations. It is preferred that the tools that have been replaced—either before or after the actual cleaning process—are brought into a tool store. Practice has shown that such a tool change is problematic if fully automatic manufacture and thus fully automatic tool cleaning is attempted. On the one hand, manipulation of the tool parts is a problem and on the other cleaning has to be carried out as rapidly as possible despite complicated handling procedures.

For this reason, it is the task of the present invention to describe an apparatus of the type referred to in the introduction hereto, and an appropriate procedure, by which rapid as well as fully automatic tool cleaning is made possible.

SUMMARY OF THE INVENTION

The above and other objects and advantages of the present invention are achieved by the provision of an apparatus for cleaning tool sets which comprise upper and lower tool sections which are separable from each other, and wherein the cleaning apparatus comprises a delivery system, a first flushing system, at least one ultrasound bath, a second flushing system, optionally a cooling system, a drying system, optionally an inspection station, and a removal system. The tools are moved by the delivery system from the core shooter or from the tool store to a first manipulator, from this to the first flushing system, preferably by means of a second manipulator into the ultrasound bath, into the second flushing system, optionally into the cooling system, and from there into the drying system, preferably by means of a third manipulator, optionally into the inspection station, to the removal system, and from this once again into the tool store or to the core shooter. According to the present invention, it is known that automatic cleaning of the tool sets—tool upper section with the ejector plate, the tool upper section, the tool lower section and optionally the transit element that serves as the tool undersection in the first shooting station is possible with a linear arrangement of the individual cleaning stations, namely by the provision of a delivery system, a first flushing system, at least one ultrasound bath, a second flushing system, optionally a cooling system, a drying system, optionally an inspection station, and a removal system. From the functional standpoint, it is essential that after removal from the core shooter, the tool sets are brought by means of the delivery system or optionally by way of the tool store or through a tool collection point to a first manipulator. It is, of course, understood that the tool transfer from the core shooter to the delivery system or to the tool store is also effected by means of manipulators although these are not described herein.

In the next step, the tool sets that are to be cleaned reach the first flushing system where any core sand that is adhering to the parts of the tool is flushed off. This is a type of rough cleaning. In a next step, the tool sets are moved into the ultrasound bath where the action of the ultrasound system, in conjunction with a suitable cleaning medium, ensures optimal cleaning. In the event that a lye is used in the ultrasound bath, this has to be rinsed off the parts of the tool in the second flushing system. From there, the parts of the tool are moved into the drying system and are then moved, preferably by means of a third manipulator, optionally into the inspection station and finally to the removal system that returns the parts of the tool or the tool sets into the tool store or back to the core shooters.

The delivery system that moves the tool parts from the core shooters or from the tool store comprises a roller-type conveyor and can, in addition, incorporate a number of manipulators. In the event that shot-hood cleaning is carried out in parallel, an appropriate roller conveyor for the shot hoods could be arranged either above or below the roller conveyor used for the tools. The use of space can be optimized in this manner.

The first manipulator is used to separate the tool set that comprises, on the one hand, the tool upper section and the ejector plate, and the tool lower section on the other. Separation in this sense is understood to be that the tool parts that are originally joined together are separated from each other so that the surfaces that are soiled with core sand are accessible for cleaning on all sides.

In an advantageous manner, the first flushing system is in the form of a basin with a holder that accommodates the tool upper section with the ejector plate and the tool lower section. It must be ensured that the parts of the tool can be set safely in the basin. The first flushing system incorporates nozzles to spray the parts of the tool, when circulating water is used for the flushing process. Adequate spray pressure can be achieved by using a delivery pump, so that the particles of sand are blasted off. In order to bring about the circulation of the so-called circulating water referred to heretofore, the first flushing system incorporates a drain line that leads into a collector basin and a delivery line that runs from the collector basin into the basin that is being used for the processing. In addition, the collector basin incorporates the pump referred to heretofore and a filter system that is used to filter out the sand that is rinsed out of the first flushing system. At this point, for example, a cyclone dust separator could be used. Sand that is filtered out is removed from the collector basin and disposed of in the usual way.

The ultrasound bath that follows the flushing system is advantageously configured as a basin with a holder that accommodates the upper section of the tool with the ejector plate and the lower section of the tool, and it is essential to ensure that the parts of the tool stand securely. Specifically, the ultrasound bath is in the form of a lye bath that is acted upon by ultrasound. With respect to particularly favourable cycle times, if there are eight tool sets to be cleaned, there will be four ultrasound baths in a linear or a parallel arrangement, these then being used to process four tool sets simultaneously.

The ultrasound bath is followed by a second flushing system that is used to flush off the lye that is wetting the tool sets, circulating water being used for this purpose. The second flushing system, too, is also in the form of a basin with a holder that accommodates the upper section of the tool with the ejector plate and the lower section of the tool. As discussed heretofore, the second flushing system, like the first flushing system, incorporates nozzles to spray the tool set, when circulating water is used here, as well. The circulating water that is used in the second flushing system could originate from the collector basin of the first flushing system. However, with regard to particularly effective cleaning, it is an advantage if the second flushing system incorporate a second collector basin and thus a drain that leads into the collector basin and a delivery line that leads from the collector basin into the basin that incorporates the nozzles. In addition, the collector basin can incorporate at least one pump to circulate the circulating water and optionally a filter system, when this filter system must, in any case, be a fine filter, preferably a filter that works according to the pervaporation process or a chemical filter.

The cooling system that follows the ultrasound bath is used to cool the tool sets that have been heated in the ultrasound bath or during the flushing process. The cooling system, too, is configured as a basin with a holder that accommodates preferably four tool sets—tool upper section with the ejector plate and tool lower section, the cooling system being filled, preferably, with circulating cooling water. The cooling system also incorporates a drain that leads into a collector basin with a cooling aggregate and a delivery line that leads from the collector basin into the basin. Here, too, a filter system can be provided in addition although this is not necessary because of the cleaning that has already been carried out. In addition, the collector basin could also incorporate a pump to circulate the cooling water.

The drying system that follows the water cooling serves to air dry the water-cooled tool sets. Drying is effected at approximately 55° C. and, in a particularly advantageous manner, utilizes hot air generated by the process. The hot air is preferably directed by a fan onto the tool parts that are to be dried. In order to reduce cycle times, a total of two drying systems in a linear and parallel arrangement can be provided.

The third manipulator, referred to in the introduction hereto, serves to bring the tool sets from the drying system into the inspection station. The inspection station could include non-contact type sensors in order to scan the surface of the tool sets. Here, on the one hand, the quality of cleaning can be monitored and, on the other, a fundamental check of the tool sets can be carried out. Of course, conventional examination by operating personnel is also possible.

In addition, the third manipulator serves to bring the tool sets onto the removal system and simultaneously assemble the tool sets in the working position—with the tool upper section and the tool lower section brought together. In other words, the parts of the tools that have been separated with the help of the first manipulator and then cleaned when so separated are positioned in an assembled state after cleaning and can be returned either to the tool store or directly to the core shooters in this state. The removal system that is used to do this includes a roller conveyor in the same way as the delivery system. In accordance with the method aspects of the present invention, the tool sets that have been replaced in the tool machines or already brought into a tool store are moved by means of a delivery system from the machine tools or the tool store to a first manipulator. The tool sets—tool upper section with ejector plate and tool lower section—are then separated by this manipulator, i.e., are disassembled to provide free access to all surfaces. The tool upper section with the ejector plate and the tool lower section are then moved into the first flushing system and the tool set that is positioned therein in its individual parts is flushed or blasted, preferably under pressure. The tool upper section with the ejector plate and the tool lower section are then moved by means of a second manipulator into an ultrasound bath and cleaned by lye and by being acted upon by ultrasound. From there, the tool set moves into a cooling system and is cooled once again to room temperature or the normal operating temperature. The tool set that has been wet with cooling water is then dried in a drying system. Finally, the now-clean tool set is moved, preferably by means of a third manipulator, into an inspection station and into the removal system for return to the tool store or directly to the core shooters.

With respect to the process according to the present invention, it is particularly advantageous if the first manipulator grips the tool upper section and the ejector plate and then the tool lower section—or vice versa—raises it, rotates it through 90° about a horizontal axis and places it in the first flushing system. It is a particular advantage if the tool upper section with the ejector plate and the tool lower section are placed in the flushing system by the first manipulator in an upright position and with the insides of the tools facing away from each other, directed outwards. This ensures that the most heavily soiled surfaces are effectively blasted. This arrangement of the tool upper section with the ejector plate and the tool lower section is maintained in the systems that follow the first flushing system, as far as the removal system, in that the particular manipulator picks up the parts of the tool in the arrangement that has been achieved and brings it to the next section.

With respect to reduced cycle times, it is an advantage if four tool sets are cleaned simultaneously in four ultrasound baths, the tool sets being brought into the ultrasound bath one after the other. In the same way, it is an advantage with respect to cycle time that four tool sets are cooled simultaneously in the cooling system, with the tool sets being brought into the cooling system one after the after in this instance, too.

In an advantageous manner, two tool sets can be dried simultaneously in the drying system, the parallel drying of only two tool sets being sufficient because process duration is not critical at that point.

The transfer of the tool set to the removal system includes the arrangement of tool upper section with the ejector plate and tool lower section, which corresponds to the working position, in the assembled state. Subsequently, the parts of the tool that were initially separated are once again re-assembled or moved into their working position. Finally, during fully automatic production of shells or core packets with eight shooting stations, it is an advantage with respect to automatic tool cleaning if, in each instance, eight tool sets are removed one after the other from the core shooters or from the tool store, and then cleaned. Processing in the individual systems or stations is effected, in an advantageous manner, in a 45-second cycle. Finally, at this point, it is mentioned that cleaning the tool sets can be carried out without any problem in two or more parallel lines, using the apparatuses according to the present invention.

There are various possibilities for effecting the teachings of the present invention in an advantageous manner and developing these. To this end, reference is made to the following explanation of one embodiment of the present invention, which is described on the basis of the drawings. In connection with the explanation of the preferred embodiment of the present invention on the basis of the drawings, the teachings are explained on the basis of a generally preferred configuration and developments.

DETAILED DESCRIPTION OF THE PREFERRED EMBODIMENTS

Figure 1:
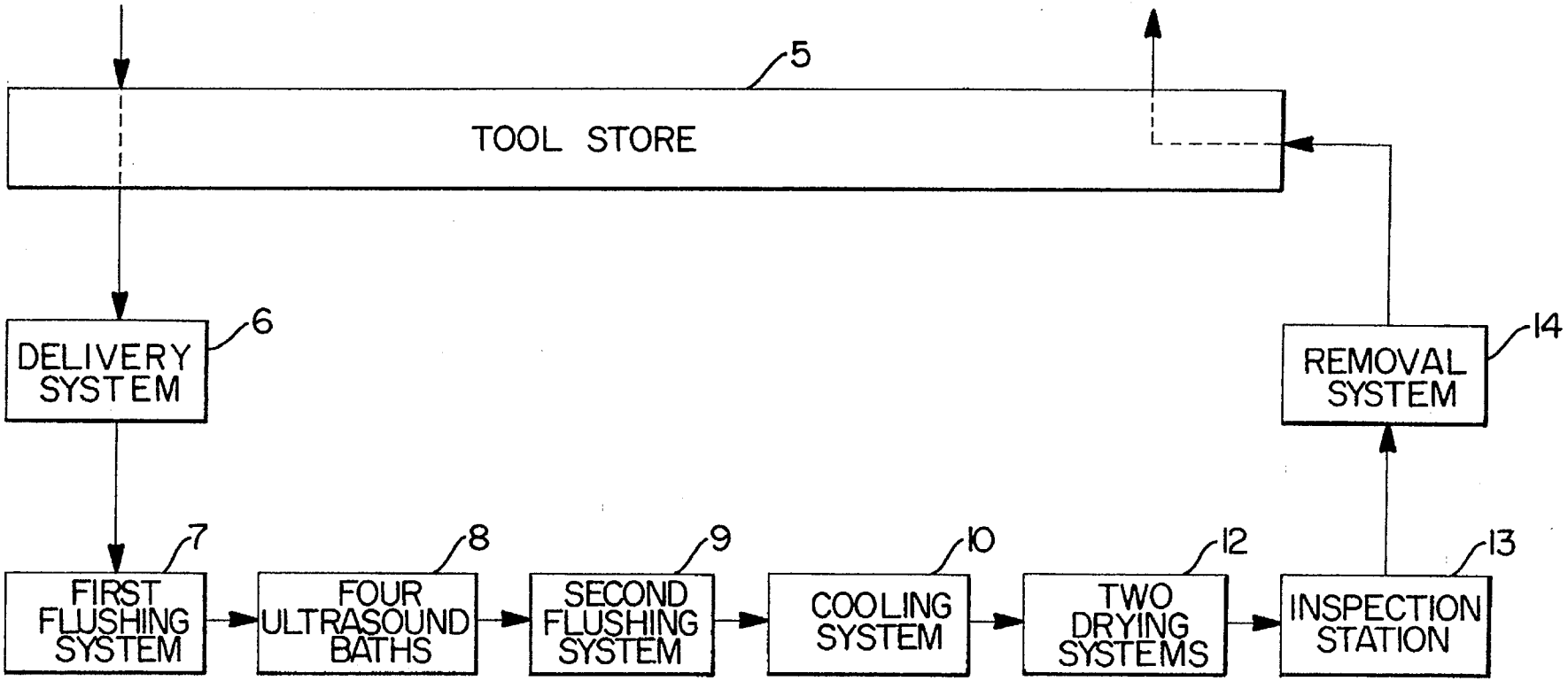
FIG. 1: a block schematic diagram of an apparatus according to the present invention for cleaning tools during the production of shells or core packets that are ready for casting, or the individual process steps of the procedure according to the present invention as a flow diagram.

FIG. 1 is a block schematic diagram that shows one embodiment of the apparatus according to the present invention that is used to clean tools during the production of shells or core packets that are ready for casting, by means of core shooters or shooting stations that are in a linear arrangement, each of the core shooters, not shown in FIG. 1, consisting of tool sets 4 that each comprise a tool upper section 1, an ejector plate 2 of the tool upper section 1 and the tool lower section 3. The tool sets 4 can be uncoupled from the core shooters (not shown herein) and removed to a tool store 5, which is only indicated herein, or directly to the cleaning station.

According to the present invention, a delivery system 6, a first flushing system 7, four ultrasound baths 8, a second flushing system 9, a cooling system 10 with four cooling spaces 11, two drying systems 12, an inspection station 13, and a removal system 14 are provided.

It can be seen from the drawings that the tool sets 4 are moved by means of the delivery system 6 from the core shooters or from the tool store 5 to a first manipulator 15. From this, the tool sets 4 are moved once again into the first flushing system 7. The tool sets 4 are then moved into the ultrasound baths 8 by means of a second manipulator 16 and then into the second flushing system 9, the cooling system 10, and from there to the drying systems 12, preferably by means of a third manipulator 17, into the inspection station 13, and finally to the removal system 14 and, by this, once again into the tool store 5 or to the core shooters (not shown herein).

Figure 2:
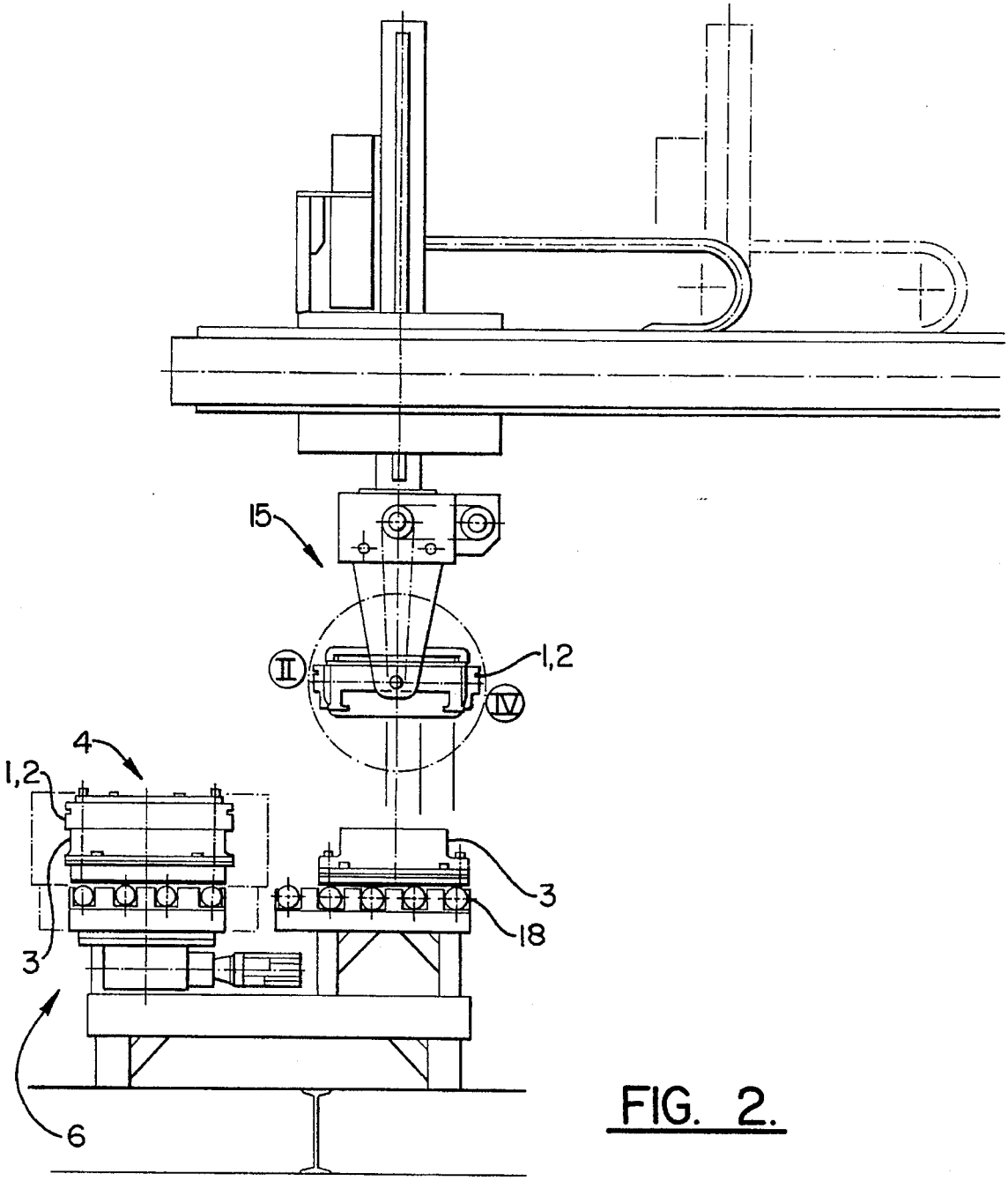
FIG. 2: a diagrammatic side view of a delivery system of the apparatus according to the present invention with a first manipulator.

FIG. 2 is a diagrammatic side view of part of the apparatus according to the present invention, namely the delivery system 6 that incorporates a roller conveyor 18. The first manipulator 15 is used to separate the tool sets 4—tool upper section 1 and ejector plate 2 on the one hand, and the tool lower section 3 on the other.

Figure 3:
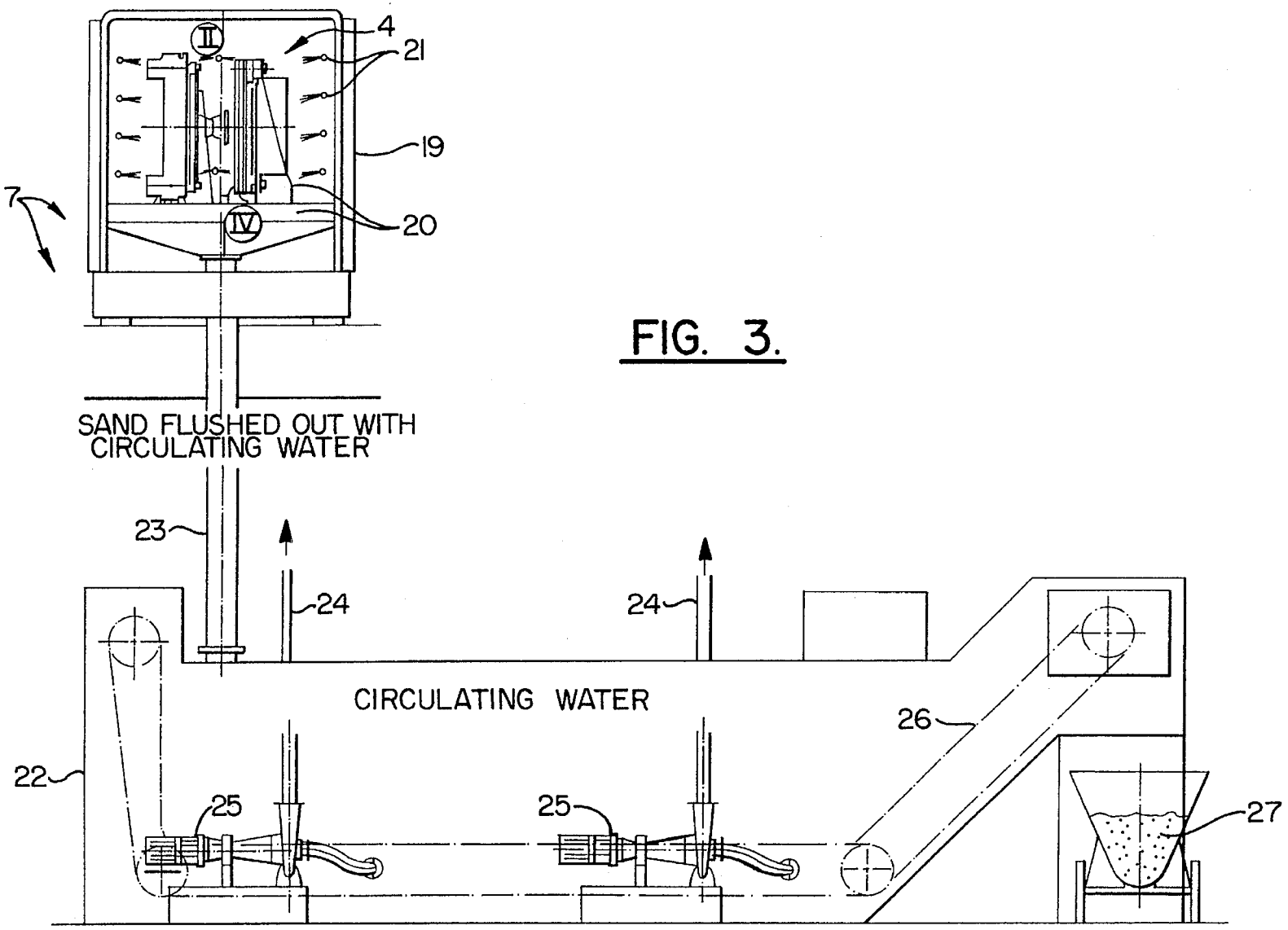
FIG. 3: a diagrammatic side view of a first flushing system in the apparatus according to the present invention.

FIG. 3 is also a diagrammatic side view that shows that the first flushing system 7 is in the form of a basin 19. A holder 20 serves to accommodate the tool set 4. FIG. 3 also shows that the first flushing system 7 incorporates nozzles 21 to spray or blast the tool set 4 with circulating water. In addition, the first flushing system 7 incorporates a drain 23 that leads into a collector basin 22 and a feed line 24 that leads from the collector basin 22 into the basin 19. The collector basin 22 has two pumps 25 and a filter system 26 that is used to filter out sand 27 that has been flushed out from the first flushing system 7.

Figure 4:
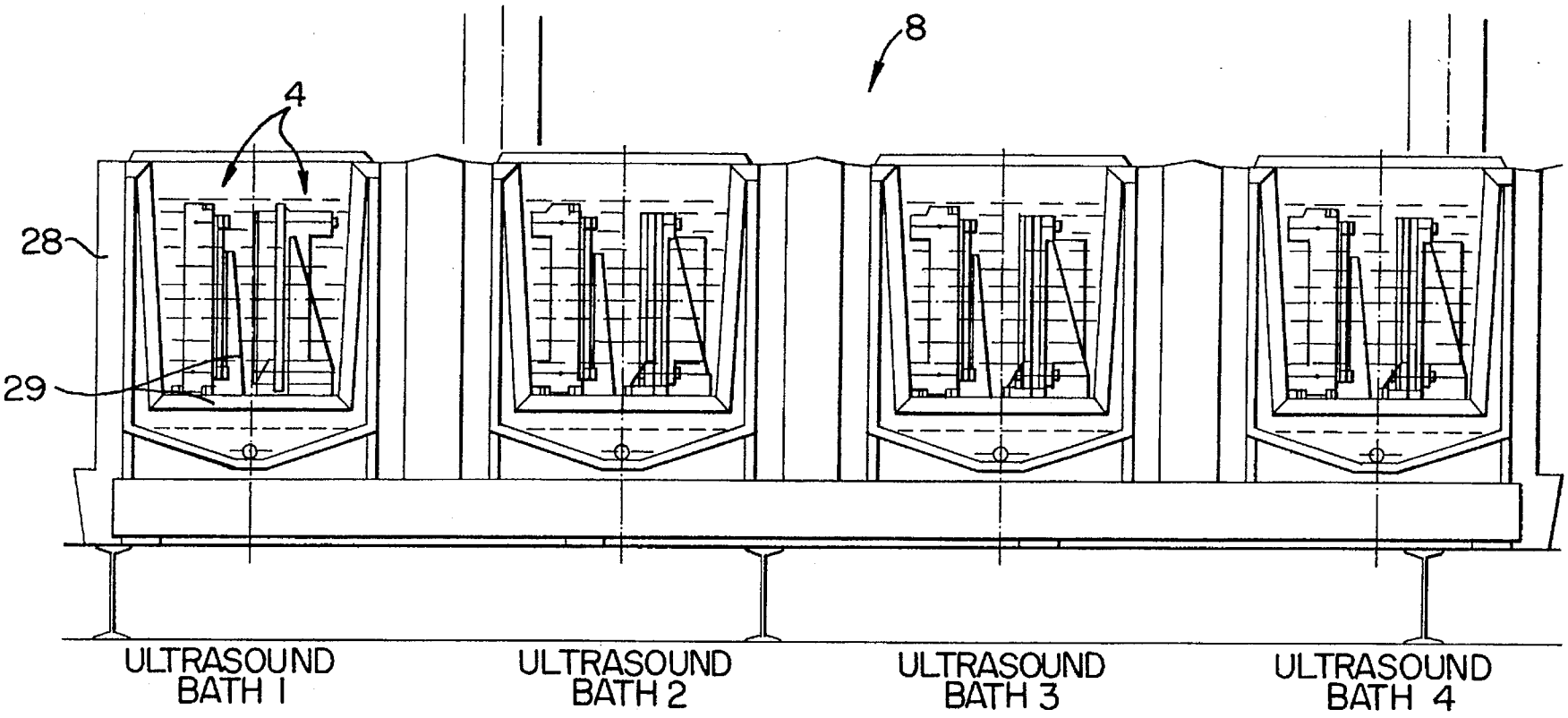
FIG. 4: a diagrammatic side view of four ultrasound baths of the apparatus according to the present invention.

FIG. 4 shows four ultrasound baths 8 that are in a linear arrangement and are in the form of basins 28 with a holder 29 that accept the tool upper section 1 with the ejector plate 2 and the tool lower section 3. The ultrasound bath 8 is a lye bath that is acted upon by ultrasound, four ultrasound baths 8 that are in a linear arrangement processing four tool sets 4 simultaneously.

Figure 5:
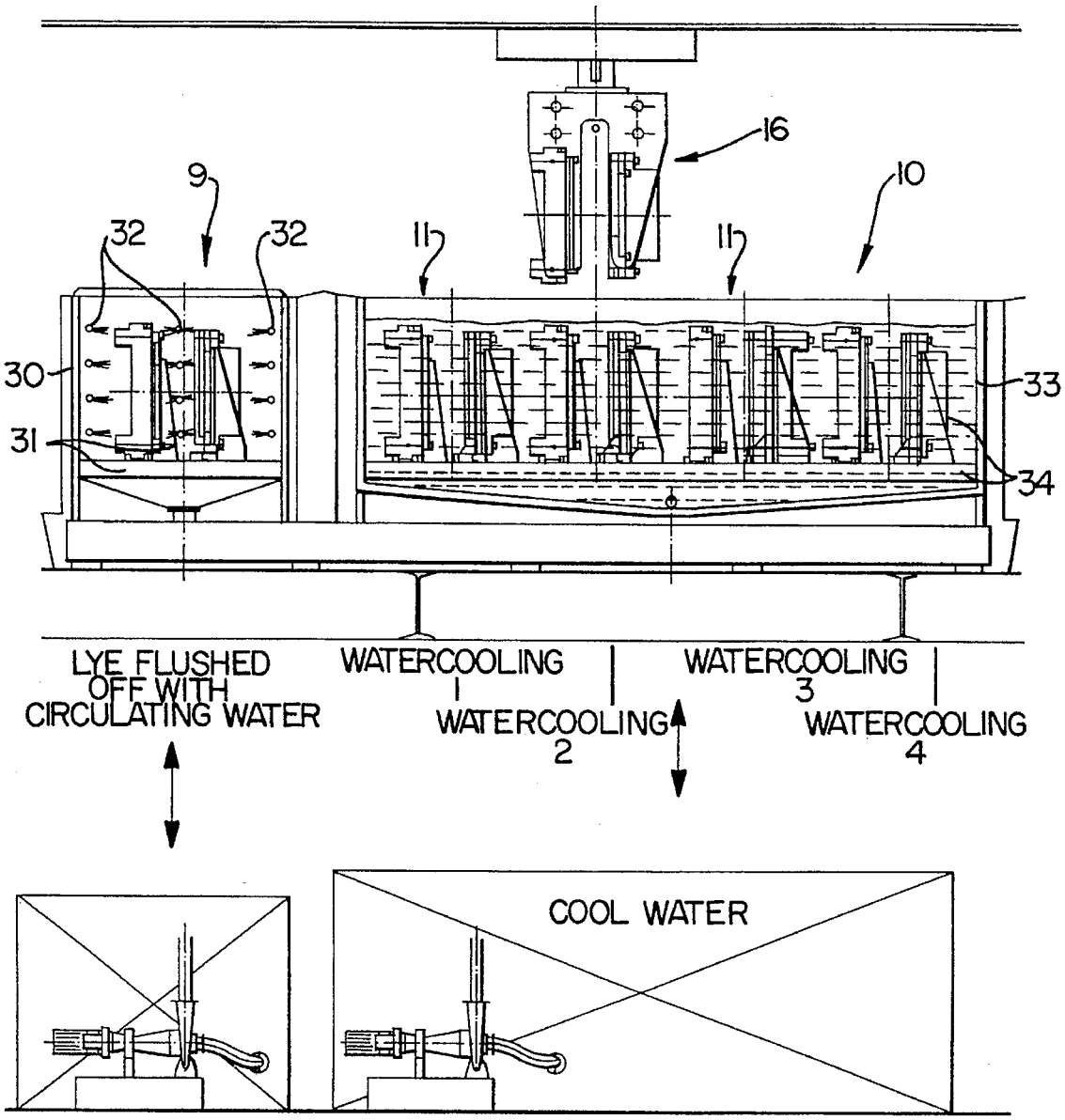
FIG. 5: a diagrammatic side view, on the one hand of a second flushing system and, on the other, of a cooling system of the apparatus according to the present invention.

FIG. 5 shows the second flushing system 9 that is used to flush off the lye that wets the tool sets 4, this being done with circulating water. The second flushing system 9 is also configured as basins 30 with holders 31 that accept the tool set 4. The second flushing system 9 incorporates nozzles 32 to spray the tool set 4 with circulating water, these also being arranged between the tool upper section 1 and the tool lower section 3.

According to the drawing at FIG. 5, the second flushing system 9 is coupled to the following cooling system 10 with respect to water supply or the circulating water. However, an independent water supply, on the one hand, for the second flushing system 9 and, on the other, for the cooling system 10 is also possible.

The cooling system 10 that is similarly shown in FIG. 5 is used to cool the tool sets 4 that have been heated in the ultrasound bath 8. The cooling system 10 is in the form of a basin 33 with a holder 34 that will accept a total of four tool sets 4. This cooling system 10 is filled with circulating cooling water. Reference is made to the general part of the description with respect to additional details.

Figure 6:
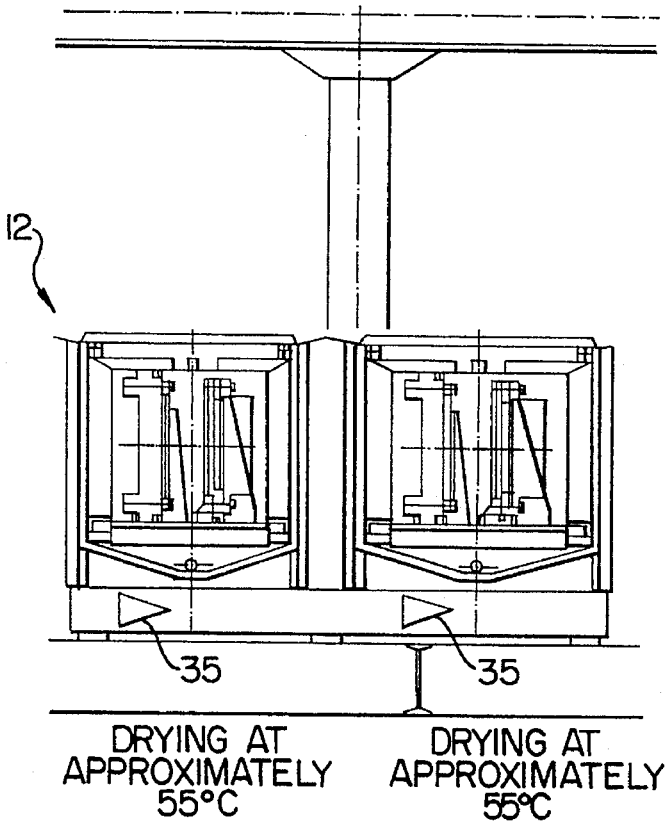
FIG. 6: a diagrammatic side view of the arrangement of two drying systems of the apparatus according to the present invention.

FIG. 6 is a diagrammatic side view of the arrangement of two drying systems 12 that are used to air-dry the tool sets 4 that have previously been water cooled. Drying is effected at approximately 55° C. by means of the fan 35 that is indicated diagrammatically.

Figure 7:
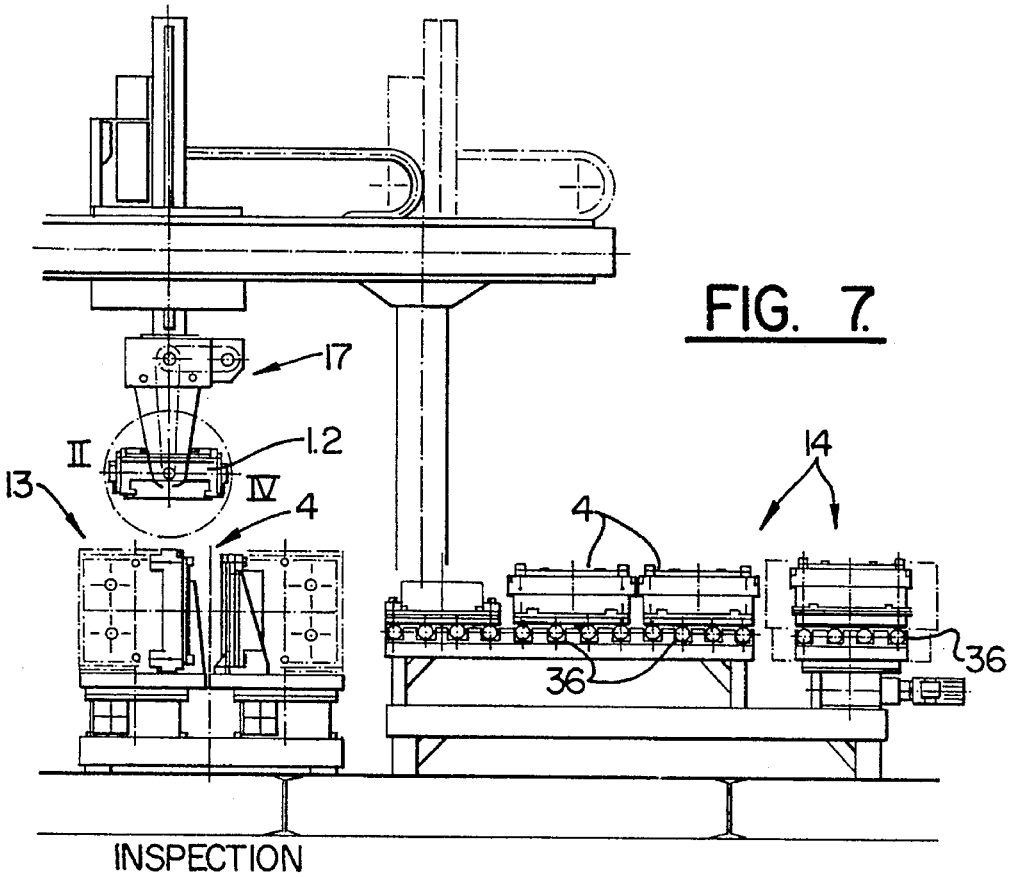
FIG. 7: a diagrammatic side view of an inspection station of the apparatus according to the present invention with a third manipulator and with a removal system.

According to the drawing shown in FIG. 7, the air drying discussed heretofore is followed by the inspection station 13, which is used, on the one hand, for inspecting cleaning quality, either completely automatically or else by operating personnel, and/or for a fundamental check of the tool set 4 on the other. The third manipulator 17 is used to bring the tool sets 4 onto the removal system 14 and to simultaneously assemble the tool sets 4 into the working position, i.e., with the tool upper section 1 and the tool lower section 3 moved together. Finally, FIG. 7 shows that the removal system 14 incorporates a roller conveyor 36.

In order to avoid repetition, reference is made to the introductory section of the description with respect to the procedure according to the present invention.

Finally, it is noted that the embodiment referred to above solely as an example merely explains the teachings of the present invention without being restricted to the embodiment so described.

We claim:

1. An apparatus for cleaning tool sets of the type adapted to mold shells or core packets that are utilized for casting metal products, and wherein the tool sets comprise a tool upper section (1), an ejector plate (2) for the tool upper section, and a tool lower section (3) which is separable from the tool upper section, said cleaning apparatus comprising a delivery system (6) for supporting the tool sets, a first flushing system (7) for spraying the tool sets with water, at least one ultrasound bath (8) for supporting the tool sets in a liquid bath which is subjected to ultrasound energy, a second flushing system (9) for spraying the tool sets with water, a cooling system (10) for cooling the tool sets which have been heated by the one ultrasound bath, a drying system (12) for air drying the tool sets, a removal system (14) for supporting the tool sets, and means for moving the tool sets from the delivery system (6) and serially to the first flushing system (7), the one ultrasound bath (8), the second flushing system (9), the cooling system (10), the drying system (12), and the removal system (14).

2. The apparatus as defined in claim 1 wherein said means for moving the tool sets comprises a first manipulator (15) for separating the tool sets prior to being moved to the first flushing system (7).

3. The apparatus as defined in claim 2 wherein the means for moving the tool sets comprises a second manipulator (16) for moving the tool sets from the first flushing system (7) into the one ultrasound bath (8), then into the second flushing system (9), and then to the cooling system (10).

4. The apparatus as defined in claim 3 wherein the means for moving the tool sets further comprises a third manipulator (17) for moving the tool sets from the cooling system (10) to the drying system (12), and then to the removal system (14).

5. The apparatus as defined in claim 4 wherein the first manipulator (15) includes means for separately gripping the upper section (1) and the ejector plate (2) on the one hand, and the tool lower section (3) on the other hand, and manipulating the same so that the inside surfaces face away from each other when deposited in the first flushing system (7).

6. The apparatus as defined in claim 4, wherein the cooling system (10) is in the form of a basin (33) with a holder (34) that is sized to accommodate a plurality of tool sets (4).

7. The apparatus as defined in claim 6, wherein the cooling system (10) is filled with circulating cooling water.

8. The apparatus as defined in claim 1 further comprising an inspection station (13), and wherein said means for moving the tool sets moves the sets from said drying system (12) to said inspection station (13) and then to the removal system (14).

* * * * *